US005782305A

United States Patent [19]

Hicks

[11] Patent Number: 5,782,305

[45] Date of Patent: Jul. 21, 1998

[54] METHOD AND APPARATUS FOR REMOVING FLUID FROM PRODUCTION TUBING INTO THE WELL

[75] Inventor: John Michael Hicks, Bakersfield, Calif.

[73] Assignee: Texaco Inc., White Plains, N.Y.

[21] Appl. No.: 746,820

[22] Filed: Nov. 18, 1996

[51] Int. Cl.[6] ..... E21B 34/06

[52] U.S. Cl. ..... 166/376; 166/317; 166/318; 166/386; 137/68.11

[58] Field of Search ..... 166/317, 318, 166/334.3, 334.4, 376, 386; 137/68.11, 68.14, 68.16

[56] References Cited

U.S. PATENT DOCUMENTS 1,643,908 9/1927 Smyser ..... 166/317
1,659,335 2/1928 Smyser ..... 166/317
1,854,477 4/1932 McKissick ..... 137/68.11
2,070,907 2/1937 Laughinghouse ..... 166/317

*Primary Examiner*—Hoang C. Dang
*Attorney, Agent, or Firm*—Henry H. Gibson; William J. Beard

[57] ABSTRACT

Methods and apparatus are provided for draining or removing well fluid from a production tubing string into a well borehole while pulling the tubing string from the well. A special length of tubing is provided near the lower end of the tubing string with a drain port communicating the interior and exterior of the tubing. The drain port is initially plugged and sealed with a knock out plug. When it is desired to remove the tubing string from the well and drain its fluid into the borehole, a drop sleeve is dropped from the surface to shear and open the knock out plug. A sleeve stop catches the drop sleeve for re-use.

10 Claims, 2 Drawing Sheets

METHOD AND APPARATUS FOR REMOVING FLUID FROM PRODUCTION TUBING INTO THE WELL

FIELD OF THE INVENTION

This invention relates to methods and apparatus for oil field use in producing wells to remove well fluid from production tubing into the well bore. More particularly, this invention relates to a method and apparatus providing an external drain port in a production tubing string and means for opening the drain port into the well borehole while the tubing string remains in the well borehole.

BACKGROUND OF THE INVENTION

In older oil fields it is sometimes necessary to pull out the production tubing string from the producing oil or gas well in order to "work over" or repair the well. In pulling the production tubing, which may comprise several thousands of feet of typically 2⅞ inch outside diameter tubing in 30 foot lengths, it is desirable to drain the fluid from the tubing string into the well bore, rather than lifting it to the surface and possibly having some of it spill onto the ground.

The most common practice used in the prior art to remove fluid from the tubing string has been to attach, at the upper end of the tubing, a perforated tubing joint at the top of the well. The production tubing is then "swabbed" by running in a synthetic "swab cup" positioned on a section of pump rod or connecting rod to the bottom end of the production tubing to be pulled. The swab cup is secured by a line to the rod and on the surface to the pulling hoist sand line. When the line is pulled up in a slow, continuous motion the well fluid is lifted inside the tubing string (i.e."swabbed") and drains out of the perforated tubing joint into the well bore at the surface end.

This technique is a rather cumbersome procedure which requires a significant amount of rig service time for several reasons. This makes a less expensive technique attractive. In many cases, due to paraffin or scale build up in the production tubing string during production from the well, it can be very difficult to run in the swab cup assembly to the bottom end of the tubing string. Also, it is possible that while slowly withdrawing the swab cup assembly, that some fluid can bypass the swab cup and remain in the tubing. This results in fluid draining onto the surface of the earth when the tubing is pulled, a very un-desirable condition.

Accordingly, there is a need for an inexpensive, simple, fast and fool proof method and apparatus for draining the fluid from production tubing into the well bore as the tubing is pulled from the well. This is provided in the method and apparatus of the present invention.

BRIEF DESCRIPTION OF THE INVENTION

The present invention provides simple, fast and economical fool proof techniques and apparatus for draining well fluid from production tubing into the well borehole as the tubing string is pulled from the bore hole. The apparatus of the present invention is easily and economically supplied from existing standard components available in the oil field. When the production tubing is first installed in the well borehole, the bottom 30 foot string is provided, near its lower end with a suitably sized (such as half inch diameter) drain port (or several such ports) spaced longitudinally apart by several inches. These ports or port are plugged with brass knock out plugs which extend radially outwardly from the tubing into the annular space between the tubing and the inside of the well casing. The tubing string may be supplied with several such ports along its length or such ports can be provided I the lowermost of the tubing collars used to join the 30 foot tubing sections. The much shorter tubing collars (six inches is typical) are easier to handle for machining in the drain holes than the 30 foot tubing lengths, but the use of either is feasible. If desired a second set of ports or a second drain port can be installed further up the tubing string from the bottom if desired.

A sleeve stop is attached to the tubing a few inches below the lowermost drain port of a set of such ports. This is a metal collar welded to the outside of the tubing or tubing collar and having a diameter just small enough to fit inside the well casing. The sleeve stop also serves to centralize the tubing string in the well casing. When it is desired to pull the tubing a heavy cylindrical steel shell or sleeve called the "drop sleeve" is placed over the tubing at the surface and dropped into the well. This sleeve is sized to fit inside the casing and to have an internal diameter large enough to pass over the tubing collars used to join the 30 foot tubing sections. As it falls into the well it gathers tremendous energy and momentum and when it reaches the brass knock out plugs protruding radially from the drain ports, it shears the brass plug and opens the port or ports. The sleeve is retrieved at the surface as the tubing is pulled out.

The invention may best be understood by reference to the following detailed description thereof, when taken in conjunction with the appended drawings. It will be understood that the drawings are illustrative and not limitative of the invention.

DETAILED DESCRIPTION OF THE INVENTION

Figure 1:
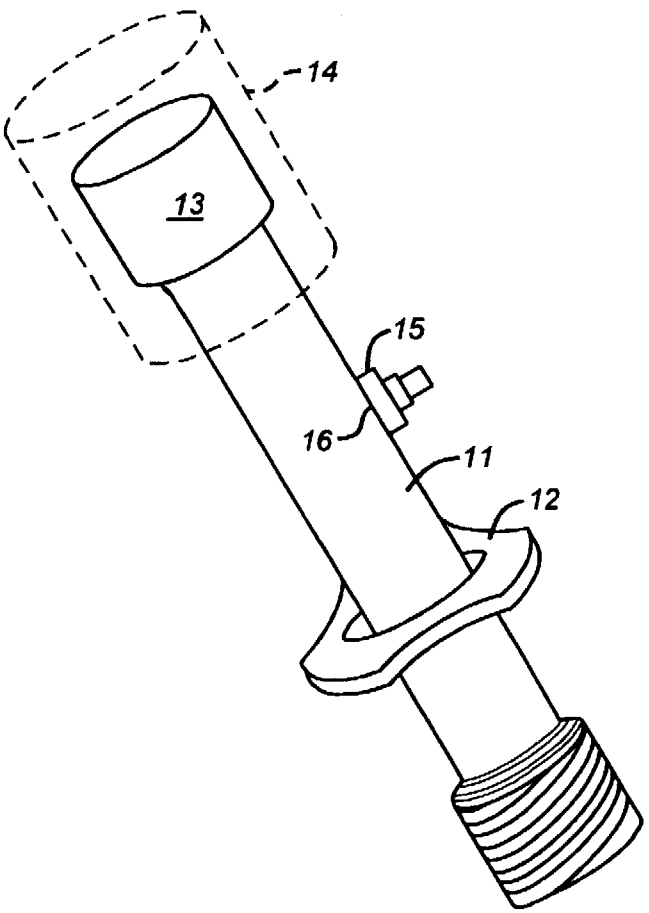
FIG. 1 is a schematic perspective view showing a length of tubing equipped with apparatus according to one embodiment of the invention.

Referring initially to FIG. 1 a schematic perspective view showing a length of well production tubing outfitted in accordance with concepts of the invention is presented. Typically the tubing string 11 has a inside diameter of 2 inches. Its outside diameter is 2.87 inches. A tubing collar 13 is used between each pair of tubing lengths to join 30 foot sections. A centralizer and sleeve stop piece 12 is welded to the outside of the tubing 11 and extends radially outwardly into almost touching engagement with the inside of a 5 inch well casing. A drop sleeve 14 (shown in phantom) is made of steel and sized to fit over the outside of tubing 11 having an inside diameter sufficient to easily clear the tubing collars 13. The tubing section 11 is provided, near its lower end, with a single drain port 16 which is plugged with a brass knock out plug 15 as shown. In operation with this embodiment, the drop sleeve 14 is fitted over the upper end of the tubing at the surface when it is desired to pull the tubing string and dropped. The sleeve 14 easily clears all tubing collars 13 and falls gaining energy and momentum for hundreds of feet until it hits brass knock out plug 15. The plug 15 is sheared by the sleeve 14 and the port 16 is opened.

This allows fluid interior to the tubing above the port to drain into the well borehole as the tubing is pulled upwardly toward the surface. The sleeve stop 12 catches the drop sleeve. When the tubing section 11 reaches the surface and is disconnected the drop sleeve 14 is recovered and, if additional tubing is to be pulled, fitted over the tubing string and dropped again to open any drain ports located lower in the tubing string.

Figure 2:
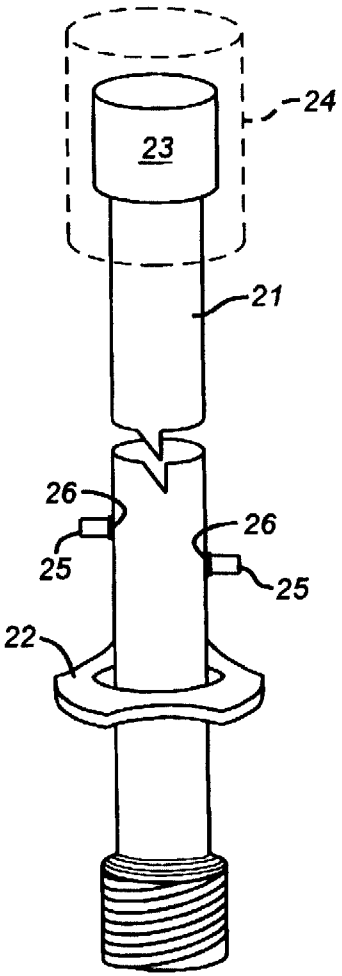
FIG. 2 is a schematic perspective view showing a second embodiment of apparatus of the present invention.

Referring now to FIG. 2 a second embodiment according to the concepts of the invention is shown in a schematic perspective view. A 30 foot tubing section 21 is provided near its lower end with a pair of vertically and circumferentially offset drain ports 26 which are machined into the tubing and are plugged with brass knock out plugs 25. The drop sleeve 24 is sized to easily clear tubing collars 23 as it falls down the tubing until it is caught by the sleeve stop 22. Functionally this embodiment may be used in exactly the same manner as that shown in FIG. 1.

Figure 3:
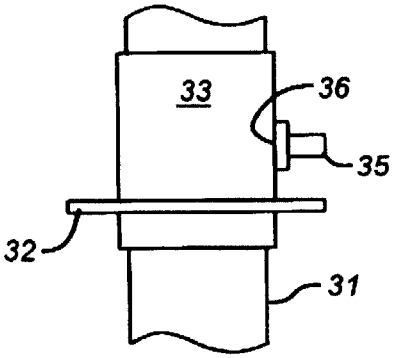
FIG. 3 is a schematic elevation showing a third embodiment of apparatus of the present invention.

Referring now to FIG. 3 yet another embodiment according to concepts of the invention is shown in a side schematic view. A tubing collar 33 is attached to the end of a section of tubing 31. The tubing collar 33 will typically be only about 6 inches long and will weigh considerably less than a 30 foot section of tubing. The collar 33 is provided with a drain port 36 which is initially plugged closed by a brass knock out plug 35 as previously described. A sleeve stop 32 is welded below the drain port and again can also function as a tubing centralizer. In operation with this embodiment the procedure is just as described previously with respect to FIGS. 1 and 2.

Figure 4:
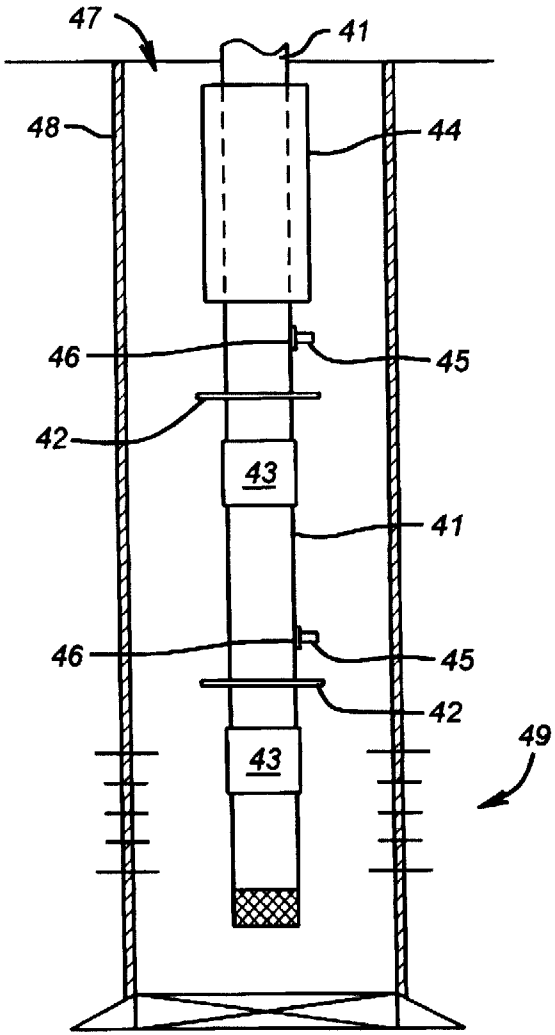
FIG. 4 is a schematic drawing in section showing deployment of apparatus according to the invention in a well bore.

Turning to FIG. 4, a production well borehole 47 is shown schematically. Production tubing 41 is run in 30 foot sections joined by tubing collars 43. Several sections of the tubing string are provided with drain ports 46 which are initially closed off by brass knock out plugs 45 as shown. These tubing sections 41 are also provided below each drain port 46 with a sleeve stop 42 which is steel and is welded to the tubing sections 41. In operation a drop sleeve 44 is placed over the tubing string 41 at the surface and falls opening upper drain port 46 by shearing off knock out plug 45. The sleeve 44 is caught by upper sleeve stop 42. When the tubing 41 has been removed from the hole (with fluid draining out into the borehole 47 via upper drain port 46) until upper drain port 46 and sleeve stop 42 are at the surface. The drop sleeve 44 is recovered and dropped down the tubing string again to open lower drain port 46 by shearing lower knock out plug 45. The drop sleeve is caught and the procedure could be repeated several times if desired to open multiple different levels of plugged drain ports provided in production tubing string when it is initially installed.

This technique has proven in field tests to be very inexpensive and reliable. Only the drop sleeve is required to shear the plugs and open the drain holes. The drop sleeves are very rugged and can be easily retrieved and repeatedly used over again. The system is extremely simple to operate and very rugged and reliable. It is operable in thermal well bore pressures and temperatures as well as in oil and gas production wells.

The foregoing descriptions may make other alternative embodiments of the invention apparent to those of skill in the art. The aim of the appended claims is to cover all such changes and modifications that fall within the true spirit and scope of the invention.

I claim:

1. Apparatus for draining well fluid from a production tubing string into a well borehole as the production tubing string is pulled from a well, comprising:

a length of tubing having near its lower end a drain port communicating from the interior of the tubing to the exterior of the tubing;

plug means for initially sealing said drain port, said plug means extending radially outwardly from the outer surface of said length of tubing; and drop sleeve means, sized to fit over said length of tubing and any joint collars used to join tubing sections, for dropping from the surface of the earth down the tubing string to said length of tubing and for shearing and opening said plug means from said drain port to allow fluid communication between the interior and exterior of said length of tubing via said drain port.

2. The apparatus of claim 1 and further including, below said drain port, a sleeve stop fixedly attached to the exterior of said length of tubing and sized to stop and catch said drop sleeve means.

3. The apparatus of claim 1 wherein said length of tubing comprises a section of production tubing.

4. The apparatus of claim 1 wherein said length of tubing comprises a tubing collar.

5. The apparatus of claim 1 wherein plural drain ports, each initially sealed with said plug means, are provided in said length of tubing.

6. A method for draining well fluid from a production tubing string into a well borehole as the production tubing string is pulled from a well, comprising the steps of:

providing a length of tubing having near its lower end a drain port communicating from the interior of the tubing to the exterior of the tubing;

initially sealing said drain port by providing a plug means sealingly engaged therein and extending radially outwardly from the outer surface of said length of tubing; and dropping, from the surface of the earth down the production tubing string, a drop sleeve sized to shear and open said plug means from said drain port to thereby allow fluid communication between the interior and the exterior of said length of tubing via said drain port.

7. The method of claim 6 and further including the step of providing, on said length of tubing below said drain port, a sleeve stop fixedly attached to the exterior of said length of tubing and sized to stop and catch said drop sleeve.

8. The method of claim 6 wherein said drain port is provided in a section of production tubing.

9. The method of claim 6 wherein said drain port is provided in a tubing collar.

10. The method of claim 6 wherein plural drain ports, each initially sealed with said plug means, are provided in said length of tubing.

* * * * *